US005613539A

United States Patent [19]

Kraler

[11] Patent Number: 5,613,539

[45] **Date of Patent: *Mar. 25, 1997**

[54] ROLL DOWN SHUTTER HAVING A ROTATING, SELF-LOCKING WINDING SHAFT

[76] Inventor: Franz Kraler, A-9913 Abfaltersbach 125, Austria

[ * ] Notice: The term of this patent shall not extend beyond the expiration date of Pat. No. 5,443,107.

[21] Appl. No.: 650,958

[22] Filed: May 21, 1996

Related U.S. Application Data

[63] Continuation of Ser. No. 374,196, Jan. 18, 1995, abandoned, which is a continuation of Ser. No. 87,793, Dec. 10, 1993, Pat. No. 5,443,107.

[30] Foreign Application Priority Data

Nov. 15, 1991 [AT] Austria ..... 2278/91

[51] Int. Cl.[6] ..... E06B 9/26

[52] U.S. Cl. ..... 160/32; 160/133

[58] Field of Search ..... 160/133, 32, 33, 160/66, 67, 383, 235, 271, 291, 23.1

[56] References Cited

U.S. PATENT DOCUMENTS

| | | | |
|---|---|---|---|
| 1,081,202 | 12/1913 | Brunst . | |
| 2,204,363 | 6/1940 | Jenkins et al. . | |
| 2,545,400 | 3/1951 | White . | |
| 2,563,549 | 8/1951 | Rogel . | |
| 2,894,572 | 7/1959 | Nelson . | |
| 3,004,591 | 10/1961 | King | 160/67 X |
| 3,263,735 | 8/1966 | Vecchiarelli et al. | 160/67 X |
| 3,970,134 | 7/1976 | Sinnock et al. | 160/133 |
| 4,033,397 | 7/1977 | McKee | 160/67 X |
| 4,077,419 | 3/1978 | Lux | 160/66 X |
| 4,217,945 | 8/1980 | Stark . | |
| 4,258,778 | 3/1981 | Upton et al. | 160/383 |
| 4,294,302 | 10/1981 | Ricke | 160/133 |
| 4,519,434 | 5/1985 | Forguer | 160/133 |
| 4,909,296 | 3/1990 | Seltke et al. | 160/67 |
| 5,070,925 | 12/1991 | Paule | 160/133 |
| 5,351,736 | 10/1994 | Laffler et al. | 160/66 |

FOREIGN PATENT DOCUMENTS

| | | |
|---|---|---|
| 1266581 | 6/1961 | France . |
| 82738 | 12/1962 | France . |
| 2458944 | 6/1976 | Germany . |
| 2644142 | 4/1978 | Germany . |
| 2740869 | 3/1979 | Germany . |
| 8559 | 3/1928 | Poland . |
| 5033 | 12/1878 | United Kingdom . |

*Primary Examiner*—David M. Purol
*Attorney, Agent, or Firm*—Lorusso & Loud

[57] ABSTRACT

Roll-down shutter with a rotating, self-locking winding shaft with coilable shutter armor made of linked interconnected shutter elements, whereby the top-most shutter element is attached to the winding shaft. In order to make an unauthorized separation of the shutters from the winding shaft practically impossible, the top-most shutter element is bound closed-shape with the winding shaft.

6 Claims, 3 Drawing Sheets

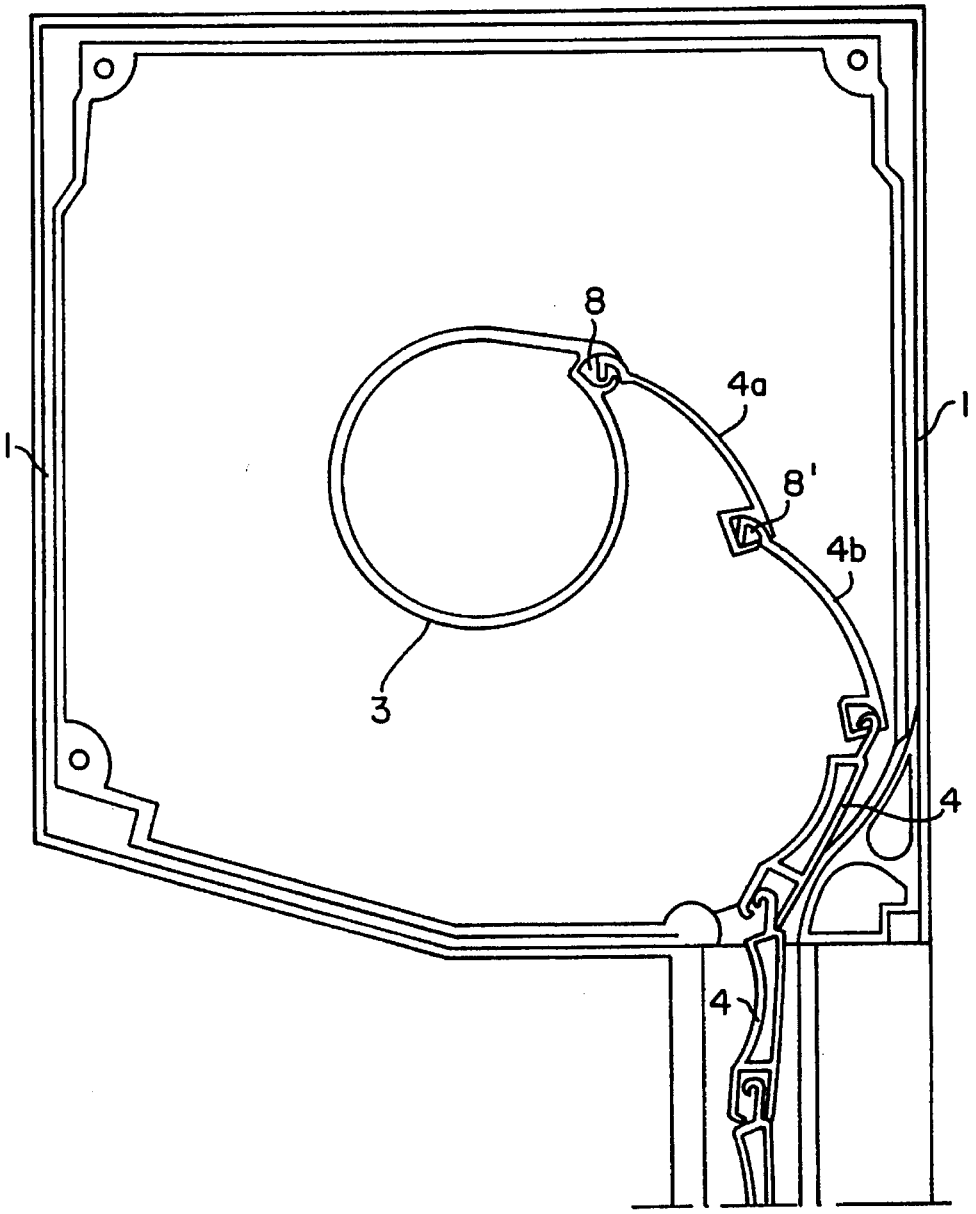
FIG. 2
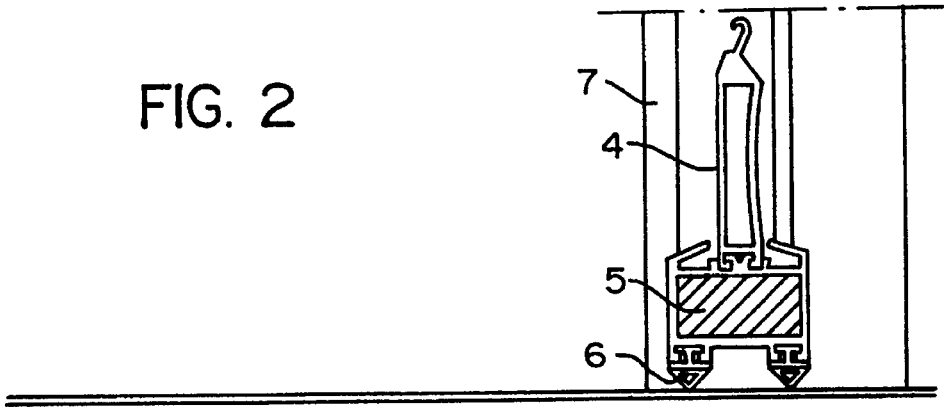

ROLL DOWN SHUTTER HAVING A ROTATING, SELF-LOCKING WINDING SHAFT

This application is a continuation of application Ser. No. 08/374,196 filed on Jan. 18, 1996 now abandoned which is a continuation of application Ser. No. 08/087,793 filed on 12/10/93 now U.S. Pat. No. 5,443,107.

FIELD OF THE INVENTION

The invention relates to a roll-down shutter comprising a rotating, self-locking winding shaft having coilable shutter-armor made of linked interconnected shutter elements, whereby the top-most shutter element is attached to the winding shaft.

BACKGROUND OF THE INVENTION

Various methods are already known for increasing the security of roll-down shutters. One such method consists of a self-locking winding shaft that is provided with a worm drive which is only rotatable by a hand crank or a motor, that can be self-turned by a motor cutoff or hand-crank and not by attacking the winding shaft. A suitable formation of the top-most shutter element together with subsequent shutter elements (usually in a shutter box), prevents any unauthorized pushing up of the shutter armor. A previous weakness was the attachment of the top-most shutter element onto the exhaust-shaft, that previously resulted from screwing or bolting. After opening the shutter box, it was thus possible for an intruder with relatively simple tools to loosen the top-most shutter element from the winding shaft thereby pulling the shutter armor away despite the shaft being in the locked position.

SUMMARY OF THE INVENTION

The invention seeks to produce a roll-down shutter of known type which provides greater security.

In accordance with the present invention, this is accomplished by a roll-down shutter comprising, a rotating, self-locking winding shaft; a plurality of linked shutter elements positioned movably in lateral guide rails, each of said linked shutter elements being pivotally connected to the other linked shutter element, said linked shutter elements further comprising a top-most linked shutter element; said top-most shutter element being pivotally and adaptedly connected to said rotating, self-locking winding shaft so that when said winding shaft is unwound, said top-most shutter element swivels away from said winding shaft up to a limited locking-angle ($\alpha$) only.

BRIEF DESCRIPTION OF THE DRAWING

FIG. 2 is a cross sectional view of another embodiment of the present invention illustrating an unwound, roll-down shutter in a locked position.

DESCRIPTION OF THE PREFERRED EMBODIMENT

Figure 1:
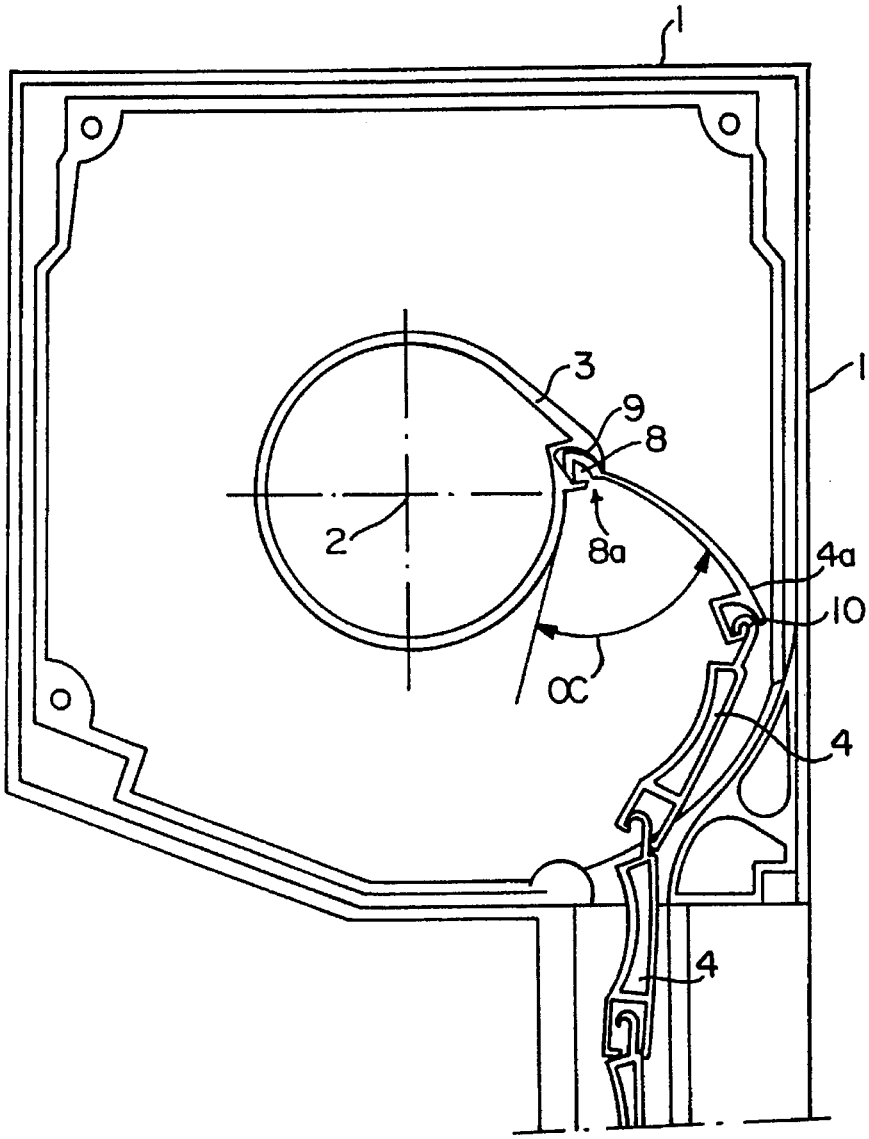
FIG. 1 is a cross sectional view of an embodiment of the present invention illustrating an unwound, roll-down shutter in a locked position.
Figure 1:
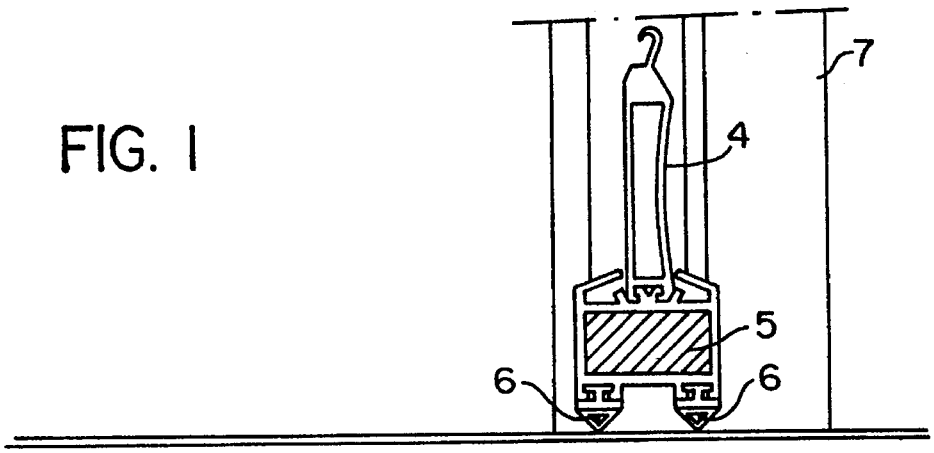

A roll down shutter with improved security is accomplished by binding the top-most shutter element to the winding shaft in a closed-shape.

Close-shaped binding, in the sense of the present invention means that the binding involves two structural pieces, the winding shaft and the top-most shutter element, wherein the cohesion of these two parts is determined by the form of these two interlocking parts and no additional binding agents, such as, screws, bolts or the like are necessary.

According to the invention, this closed-shape binding holds the two part, the winding shaft and top-most shutter element, undetachably together. In contrast to a closed-shape where the parts are correspondingly bound together with essentially no slippage, the closed shaped binding of the present invention permits restricted relative movement of the two parts. The top most shutter element may not be removed in a radial direction perpendicular to the axis of the winding shaft, but the binding is not completely fixed. It is possible to tilt or pivot the element and to remove it or insert it in an axial direction.

In a preferred embodiment, such a closed-shape binding between the winding shaft and top-most shutter element forms a first binding section in the axial direction on the winding shaft and a second binding section on the top-most shutter element in the axial direction of the shaft. The first binding section is joined to the second binding section to attach the shaft to the top-most shutter element - preferably with some looseness (play). With the assembly of the roll-down shutter, the two binding sections can simply be pushed into one another in the axial direction and held together in closed-shape, whereby removal of the top-most shutter element in any radial direction out of the winding shaft is not possible. Since a radial pushing out of the top-most shutter element is not possible with insertion into the winding shaft, and since releasable binding agents such as screws, bolts, or similar are not provided, the top-most shutter element cannot be separated from the winding shaft, thus making it impossible for the intruder to pull up the shutter.

Further advantages and features of the invention will be described in more detail in the following description of the drawing.

FIG. 1 illustrates the roll-down shutter of the present invention encompasses a winding shaft (3) positioned in a shutter box (1) rotatable around the axial beam (2). Axial beam (2) is self-locking, i.e., it is not able to be turned from the outside by a stationary driving motor or operating crank. One way of attaining this locking feature is through incorporation of a worm drive, for example. FIG. 1 shows a roll-down shutter of the present invention in the unwound condition, and further shows interlocking shutter elements comprising a top-most interlocking element (4*a*) and a plurality of interlocking shutter elements (4) with shutter armor. The shutter elements (4) beneath the shutter box (1) are driven along two guide rails (7) at the side. Interlocking shutter elements (4) terminate in a bottom most shutter element (5) comprising The shutter armor with steel inserts with added packing strips (6) on its underside being made of elastic material.

According to the invention, the top-most shutter element (4*a*) is bound in closed-shape with the winding shaft (3) without the means of fastening agents such as screws, bolts, or the like.

In addition, as primary binding section a slot (8) that extends towards the winding shaft in the axial direction is provided. The top-most shutter element comprises a second binding section (9) formed through a structured longitudinal-edge. The slot (8) has a widened region and a slot opening (8*a*). The binding section (9) of the top-most shutter element (4*a*) has a greater cross-sectional diameter in the widened region of the slot (8) than that of the external slot-opening (8*a*). Thus the top-most shutter element (4*a*), upon insertion to the winding shaft, cannot be extracted therefrom. The top-most shutter element (4*a*) can be easily inserted into the slot in the axial direction during assembly of the roll-down shutter. However as stated with roll-down shutter construction, an axial expulsion of the top-most shutter element (4*a*) in all practical instances is not possible, and for special installations additional security i.e. pins, pegs, or the like against axial displacement of the top-most shutter element can be added.

The slot (8) and its terminal wall can be formed in one piece with the winding shaft in order to prepare a stable support for the top-most shutter element (4*a*). The winding shaft can be formed as a hollow extruding aluminum section which is comparatively easy to produce and can be cut to the desired length, In order to facilitate a spatially acceptable unwinding of the shutter armor by the winding shaft and yield a locking function against undue pushing up of the armor, the top-most shutter element (4*a*) is preferably positioned on the winding shaft with the ability to swivel. The top-most shutter element (4*a*) and the winding shaft (3) are so structured that the top-most shutter element originates from an existing point confined to the winding shaft (see for example wound roll-down shutter in FIG. 3). After the roll-down shutter is unwound so that the bottom-most shutter element (5) is set below accordingly, top-most shutter element can only be swung away at a maximum angle α from the winding shaft. The winding shaft can be turned further clockwise until the position represented in FIG. 1 is created, by which the top-most shutter element (4*a*) is turned as far away as possible from the winding shaft (3), and projects under the lock-angle α from the winding shaft (3). In this position the top-most shutter element (4*a*) can no longer be turned further from above. Since the winding shaft (3) is self-locking, it can also not be turned counter-clockwise, thus an unauthorized pushing-up of the shutter armor is not possible.

Figure 3:
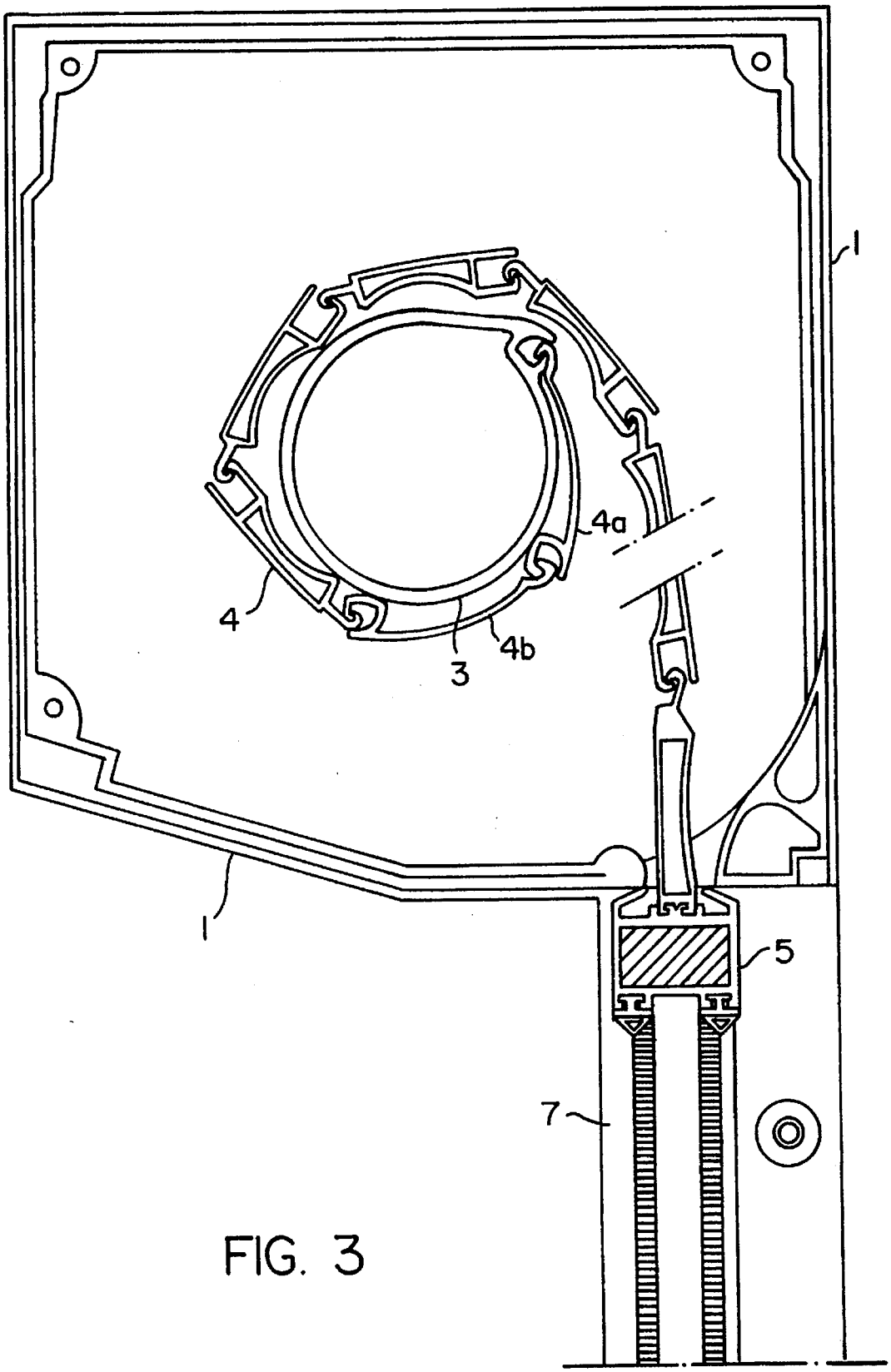
FIG. 3 is a cross sectional view of the embodiment shown in FIG. 2 illustrating partially, a wound-up, roll-down shutter (armor).

The top-most shutter element (4*a*) also performs a locking function. Because it always stays within the shutter box, it can be alternatively formed with unwound shutters as the visible preferably hollow structured shutter element. In particular, the top-most shutter element can be a laminated locking section extending over the whole length of the winding shaft, whose one sectioned longitudinal-edge is bound with the winding shaft and whose other sectioned longitudinal borders stand linked with the next shutter element (4) in the binding. One such preferably curved locking section in cross-section withstands high stress-effect and, as shown in FIG. 3, can lie compactly in a coiled state on the peripheral area of the winding shaft (3). The top-most shutter element (4*a*) which performs this locking function is preferably made of Aluminum.

In addition to the locking function that is given throughout when the top-most shutter element (4*a*) can only be turned in a limited dial sector across the winding shaft (3), a locking effect can be achieved throughout by adjoining the top-most shutter element (4*a*) and the winding shaft (3) away from the longitudinal edge (10) on the inside wall of the shutter box (1).

The schematic representations of FIGS. 2 and 3 differentiate themselves from FIG. 1 essentially through a larger shutter box (1) for the incorporation of larger shutter armor. In addition to a topmost shutter element (4*a*) there is second shutter element (4*b*). Second shutter element (4*b*) is substantially the same structure as top-most shutter element (4*a*). Both, top-most shutter element (4*a*) and second shutter element (4*b*), are positioned with the ability to swivel, and in combination, they perform a locking function in a similar manner as described for the embodiment shown in FIG. 1.

FIG. 2 shows the locked position which prevents an unauthorized pushing-up of the shutter armor. Thereby the feature of second shutter element (4*b*), that is that can be rotated across the top-most shutter element (4*a*) up to a lock-angle of ≈180°. The slot 8' provided on the outside longitudinal-edge of the top-most shutter element (4*a*) can be formed essentially the same as the integrated slot (8) in the winding shaft (3). Also top-most shutter element (4*a*) and second shutter element (4*b*) are close-shaped, in the sense of the invention interlocked, and cannot be separated from one another upon insertion to the roll-down shutter.

FIG. 3 shows the winding process and in particular how top-most shutter element (4*a*) and second shutter element (4*b*) are structurally slim enough to lie flush on the peripheral area of the winding shaft (3).

The invention is not limited to the embodiments represented. For example the top-most shutter element (4*a*) may not extend over the entire length of the winding shaft (although this occurs advantageously for reasons of technical production and stability). It would be also conceivable that the top-most shutter element (4*a*) and the adjacent interlocked shutter element in each case consist of two or more axial adjacent shutter element(parts), on which the proper shutter armor is placed. In the represented embodiments the winding shaft comprises a slot in which the top-most shutter element is held close-shaped. It would also be conceivable that the slot is formed on the top-most shutter element and comprises a projecting shoulder from the winding shaft in order to bind the shaft with the top-most shutter element making it safe from intrusion.

What is claimed is:

1. A roll-down shutter comprising, a rotating, self-locking winding shaft;

a plurality of linked shutter elements positioned movably in lateral guide rails, each of said linked shutter elements being pivotally connected to the other linked shutter element, said linked shutter elements further comprising a top-most linked shutter element made of rigid material;

said top-most shutter element extending over the entire length of said winding shaft and being pivotally connected to said rotating, self-locking winding shaft so that said top-most shutter element may swivel with respect to said winding shaft between a first and a second angular position, said top most shutter element lying essentially tangentially to said winding shaft in said first angular position and under a limited locking angle α to the tangent to said winding shaft in said second angular position, the pivotal connection between said top-most shutter element and said winding shaft being such that the top-most shutter element cannot swivel beyond said second angular position.

2. The roll-down shutter according to claim 1, wherein said locking angle (α) is between 30° and 90°.

3. The roll-down shutter according to claim 1, so that when said shutter elements are completely lowered, said top-most shutter element is in said second angular position.

4. The roll-down shutter according to claim 1, wherein said top-most shutter element is pivotally connected to a second shutter element, said second shutter element being adapted to swing away from said top most shutter element up to but not beyond a predetermined, limited second locking-angle of about 180°.

5. The roll-down shutter according to claim 4, so that when said shutter elements are completely lowered, said second shutter element projects under said second locking angle from that top-most shutter element.

6. The roll-down shutter according to claim 1, having a shutter box housing with a substantially vertical housing wall, said wall having an inner and outer face, said top-most shutter element additionally locking against said inner face of said wall in said second angular position of said top-most shutter element.

* * * * *